US006389146B1

(12) United States Patent
Croft, III

(10) Patent No.: US 6,389,146 B1
(45) Date of Patent: May 14, 2002

(54) ACOUSTICALLY ASYMMETRIC BANDPASS LOUDSPEAKER WITH MULTIPLE ACOUSTIC FILTERS

(75) Inventor: James J. Croft, III, Poway, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

(21) Appl. No.: 09/505,553

(22) Filed: Feb. 17, 2000

(51) Int. Cl.[7] ..... H04R 25/00

(52) U.S. Cl. ..... 381/345; 381/351; 381/349; 381/350

(58) Field of Search ..... 381/71.4, 71.7, 381/163, 186, 335, 338, 345, 349, 350, 351, 389; 181/145, 155, 156, 182, 183, 189, 198, 199

(56) References Cited

U.S. PATENT DOCUMENTS

| | | | | | |
|---|---|---|---|---|---|
| 1,969,704 | A | | 8/1934 | D'Alton | 181/31 |
| 2,689,016 | A | * | 9/1954 | Lang | 181/145 |
| 4,549,631 | A | * | 10/1985 | Bose | 181/155 |
| 4,875,546 | A | * | 10/1989 | Krnan | 181/160 |
| 4,924,963 | A | * | 5/1990 | Polk | 181/144 |
| 5,025,885 | A | * | 6/1991 | Froeschle | 181/156 |
| 5,092,424 | A | * | 3/1992 | Schreiber et al. | 181/145 |
| 5,374,124 | A | * | 12/1994 | Edwards | 381/90 |
| 5,479,520 | A | * | 12/1995 | Nieuwendijk et al. | 381/350 |
| 5,659,157 | A | * | 8/1997 | Schulte | 181/156 |
| 5,714,721 | A | * | 2/1998 | Gawronski et al. | 181/156 |
| 5,731,553 | A | | 3/1998 | Ledoux | 181/156 |
| 5,749,433 | A | * | 5/1998 | Jackson | 181/156 |
| 6,169,811 | B1 | * | 1/2001 | Croft, III | 381/186 |
| 6,223,853 | B1 | * | 5/2001 | Huon et al. | 181/145 |

FOREIGN PATENT DOCUMENTS

| | | |
|---|---|---|
| EP | 0 125 625 | 9/1984 |
| JP | H2-260910 | 9/1990 |

OTHER PUBLICATIONS

"A Bandpass Loudspeaker Enclosure", Fincham, L.R., Presented at the 63rd Convention, May 15–18, 1979 Los Angeles.

* cited by examiner

*Primary Examiner*—Sinh Tran
*Assistant Examiner*—P. Dabney
(74) *Attorney, Agent, or Firm*—Thorpe North & Western, LLP

(57) ABSTRACT

In a preferred embodiment, a bandpass loudspeaker enclosure includes three sub chambers, a first one being a non-Helmholtz-reflex chamber of a sealed acoustic suspension construction, and the remaining two chambers utilizing two passive acoustic radiators to achieve two Helmholtz-reflex vent tunings and a multiple of low pass acoustic filters that provide an acoustic bandpass with a substantially 2nd order high pass characteristic combined with an extended, steeper, at least 4th order slope low pass stop band characteristic.

34 Claims, 7 Drawing Sheets

ACOUSTICALLY ASYMMETRIC BANDPASS LOUDSPEAKER WITH MULTIPLE ACOUSTIC FILTERS

BACKGROUND OF THE INVENTION AND RELATED ART

This invention relates to improved, low frequency bandpass loudspeaker systems. In the art of loudspeaker enclosures there are two basic types of systems that are most common. The sealed or acoustic suspension system, which consists of an electroacoustical transducer mounted in an enclosed volume that has the characterization of acoustic compliance. The second type is what is commonly called a bass-reflex system which includes an electroacoustic transducer mounted in an enclosure that utilizes a passive acoustic radiator which includes the characteristic of acoustic mass which interacts with the characteristic acoustic compliance of the enclosure volume to form a Helmholtz resonance. A reflex system, enclosure/vent—compliance/mass, that exhibits a Helmholtz resonance shall be referred to hereinafter as a Helmholtz-reflex.

One of the prior art configurations relevant to the invention is the multi-chamber bandpass woofer system. Historically it has been shown that for a given restricted band of frequencies an acoustical bandpass enclosure system can produce greater performance both in terms of the efficiency/bass extension/enclosure size factor and large signal output compared to non-bandpass systems such as the basic sealed or bass reflex enclosures. The basic forms of these bandpass systems are discussed in the literature. See for example A bandpass loudspeaker enclosure by L. R. Fincham, Audio Engineering Society convention preprint #1512, May.

The earliest patent reference to a single Helmholtz-reflex tuned bandpass woofer system is Lang, 'Sound Reproducing System' U.S. Pat. No. 2,689,016. This patent reference anticipates the most common version of bandpass woofer system that is used in many systems today. This type of system includes an enclosure with two separate chambers with an active transducer mounted in the dividing panel and communicating to both chambers. One chamber is sealed, acting as an acoustic suspension and the other is ported, operating as a vented system with a passive acoustic mass communicating to the environment outside the enclosure.

The single tuned prior art bandpass woofer systems suffer from a number of shortcomings. First, they tend to have a series of resonant amplitude peaks that appear above the pass band of the bandpass system. These are due to standing waves in the enclosure and are well documented in the article by Fincham listed above. Prior art solutions to this problem suggest the use of damping materials which unfortunately damp out useful system output at the same time they damp out the undesired resonances. Secondly, they have a cone excursion minimum at their Helmholtz-reflex frequency, but there is only one tuning and it is placed at a frequency near the highest frequency of interest where cone excursion is insignificant compared to the lower frequency range of the system. If the vent tuning is placed at a lower, more useful frequency then the system suffers from reduced high frequency bandwidth.

The next evolutionary step in complexity of a prior art bandpass woofer is expressed in the earliest patent reference to a dual Helmholtz-reflex bandpass woofer system in FIG. 2 in D'Alton, "Acoustic Device" U.S. Pat. No. 1,969,704. This reference discloses an enclosure containing a two chamber bandpass woofer system with an active transducer mounted in the dividing panel and communicating to both chambers. Each chamber has a passive acoustic radiator communicating to the environment outside the enclosure. European patent 0125625 "Loudspeaker Enclosure with Integrated Acoustic Bandpass Filter" by Bernhard Puls and U.S. Pat. No. 4,549,631 "Multiple Porting Loudspeaker Systems" granted to Amar G. Bose are derived from the same basic structure as shown in the D'Alton reference.

An alternative arrangement of a dual Helmholtz-reflex bandpass system is disclosed in the U.S. Pat. No. 4,875,546 "Loudspeaker with Acoustic Band-pass Filter" granted to Palo Kmnan. This system includes an enclosure with two separate chambers with an active transducer mounted in the dividing panel and communicating to both chambers. One chamber is ported with a passive acoustic radiator communicating to the environment outside the enclosure. There is a second passive acoustic radiator communicating internally between the two chambers.

These dual tuned bandpass subwoofers suffer from the same out of band, high frequency resonances that are endemic to the single tuned bandpass system. Further, by venting the lowest frequency chamber the lower frequency, out of band performance suffers below vent Helmholtz-reflex tuning, resulting both in a reduction of amplitude of output and an increase in diaphragm amplitude with a corresponding increase in distortion. This causes a steeper rolloff slope and increased distortion at frequencies below system cutoff. Because of this the system of this type does not lend itself to equalization below the lowest vent tuning frequency and therefore does not have useable output below this vent tuning frequency.

U.S. Pat. No. 5,092,424 "Electroacoustical Transducing with at Least Three Cascaded Subchambers" granted to Schreiber, et al, is an extension of the above listed bandpass art. It utilizes an enclosure with at least three chambers such that it is substantially equivalent to the Bose '631 patent listed above, but with an additional enclosure volume added to the outside of the main enclosure. This additional enclosure receives the two ports from the internal main chambers and an additional passive acoustic radiator communicates to the environment outside the system. This system suffers from the same low frequency problems as the dual tuned bandpass systems.

Each of the above patents have shortcomings that have limited the full potential of the bandpass approach for low frequency reproduction. In general, the above systems either suffer from both a steep, highpass cutoff in the bass range where the most output is desired and/or a slow, lowpass cutoff in the higher frequencies where the greatest extension with the sharpest cutoff is most desirable and unattenuated resonances that can cause audible distortion.

It would be desirable to have a woofer system that combines a mild 2nd order high pass rolloff characteristic at the low frequencies with an extended frequency, steep slope lowpass characteristic at the high frequencies.

SUMMARY AND OBJECTS OF THE INVENTION

It is an object of this invention to utilize a multiple low pass, acoustic filter characteristic to filter out internal resonances and minimize their acoustical output.

It is the further object of the invention to utilize at least a double, acoustical, low pass filter characteristic to filter out audible distortion components that are generated when producing high output levels.

It is the further object of the invention to provide smaller internal chambers in which any remaining standing wave resonances are moved up to a higher, out of band frequency, preferably removed from the operating range of the invention.

It is a further object of the invention to form a hybrid bandpass/high pass woofer system that can achieve extended frequency response and minimized cone excursion.

It is a further object of the invention to create an acoustic bandpass having a steep slope low pass characteristic to allow a higher crossover point and/or achieve acoustical filtering of transducer distortion while, also exhibiting a more gradual high pass characteristic, extending the lowest frequencies.

It is the still further object of the invention to utilize its extended response and steep slope to allow higher crossover frequency and reduced out of band distortion and therefore significantly reduce the size and cost requirements of the upper range satellite speakers being used with the invented woofer system.

These and other objects are realized by the present invention which in a preferred embodiment provides a novel loudspeaker system incorporating an enclosure with a total of three subchambers and two Helmholtz-reflex tunings. The first of the multiple chambers operates as a non-Helmholtz-reflex, acoustic suspension chamber, while the remaining subchambers operate as Helmholtz-reflex chambers providing a double low pass characteristic. The invented loudspeaker enclosure has at least two acoustic lowpass filters between one side of the electroacoustic transducer and the outside environment. The other side of the electroacoustic transducer is housed in a non-Helmholtz-reflex, substantially sealed, acoustic suspension subchamber.

Other embodiments are represented in a loudspeaker system comprising at least one electroacoustical transducer for converting an input electrical signal into corresponding acoustic output and an enclosure divided into at least first, second and third subchambers by at least first and second dividing walls. The first dividing wall supports and coacts with the at least one electroacoustical transducer to bound the first and second subchamber. At least one passive acoustic radiator is specifically designed to realize a predetermined acoustic mass, intercoupling the second and third subchambers. At least one additional passive acoustic radiator is specifically designed to realize a predetermined acoustic mass and intercouples at least one of the second and third subchambers with the region outside said enclosure. Each of the subchambers has the characterization of acoustic compliance. The passive acoustic radiator masses interact with second and third subchamber compliances to form a total of two Helmholtz-reflex tunings at two spaced frequencies in the passband of the loudspeaker.

An additional embodiment of the present invention comprises a loudspeaker system comprising at least one electroacoustical transducer for converting an input electrical signal into a corresponding acoustic output and an enclosure divided into N number of subchambers by at least N−1 number of dividing walls with $N \geqq 3$. The first dividing wall supports and coacts with the at least one electroacoustical transducer to bound the first and a second subchamber. At least one passive acoustic radiator is specifically designed to realize a predetermined acoustic mass and couples each subchamber to a region outside each subchamber except for the first subchamber. At least one additional passive acoustic radiator is specifically designed to realize a predetermined acoustic mass and intercouples at least one of the subchambers, other than the first subchamber, to the region outside the enclosure. The first subchamber is characterized as operating in a non-Helmholtz-reflex mode and each of the remaining subchambers have the characterization of acoustic compliance. The passive acoustic radiator masses interact with subchamber compliances to form a total of N−1 Helmholtz-reflex tunings at spaced frequencies in the passband of the loudspeaker.

Yet another embodiment of the loudspeaker system comprises at least one electroacoustical transducer having a vibratable diaphragm for converting an input electrical signal into a corresponding acoustic output signal and an enclosure divided into at least first, second, third and fourth subchambers by at least first, second and third dividing walls. The first dividing wall supports and coacts with the at least one electroacoustical transducer to bound the first and second subchambers. At least one passive acoustic radiator is specifically designed to realize a predetermined acoustic mass and intercouples the second and third subchambers. At least one additional passive acoustic radiator is specifically designed to realize a predetermined acoustic mass and intercouples the third and fourth subchambers. At least a second additional passive acoustic radiator is specifically designed to realize a predetermined acoustic mass and intercouples at least one of the second, third, or fourth subchambers with the region outside the enclosure. Each of the second, third and fourth subchambers has the characterization of acoustic compliance. The passive acoustic radiator masses and the acoustic compliances are selected to also establish a total of three spaced frequencies in the passband of the loudspeaker system at which the deflection characteristic of the vibratable diaphragm as a function of frequency has a minimum.

A still further embodiment of this invention is represented by a loudspeaker system having at least one electroacoustical transducer for converting an input electrical signal into a corresponding acoustic output and an enclosure divided into at least first portion of a first subchamber and second and third subchambers by at least first and second dividing walls. The first dividing wall supports and coacts with the at least one electroacoustical transducer to bound the first portion of the first subchamber and the second subchamber. At least one passive acoustic radiator is specifically designed to realize a predetermined acoustic mass and intercouples the second and third subchambers. At least one additional passive acoustic radiator is specifically designed to realize a predetermined acoustic mass and intercouples at least one of the second and third subchambers with the region outside the enclosure. Each of the second and third subchambers has the characterization of acoustic compliance. The passive acoustic radiator masses interact with second and third subchamber compliances to form a total of two Helmholtz-reflex tunings at two spaced frequencies in the passband of the loudspeaker. The first portion of the first subchamber includes mounting structure for attachment to an additional enclosed space that completes enclosure of the first subchamber as a substantially closed, acoustic suspension chamber.

An additional embodiment of the present loudspeaker comprises a combination of Helmholtz-reflex and non Helmholtz-reflex chambers which acousti-mechanically define an asymmetric bandpass characteristic having an upper stop band which has the characteristic of at least a third order slope, and lower stop band operable with a substantially second order slope.

A further aspect of the present invention provides a method for acousti-mechanically configuring a low range speaker system for use in an audio system to enhance audio output capability. This method comprises the steps of a)

configuring the low range speaker system to include multiple, lowpass acoustic filter structures to achieve at least a third order acoustic low pass characteristic, and b) configuring the low range speaker system for operation with a substantially second order high pass characteristic.

In addition, the present invention is characterized by a loudspeaker the enclosure has outer side walls which bound the enclosure to the outside environment, wherein at least one additional passive acoustic radiator comprises at least one compliant sheet that intercouples the third subchamber through at least one of the outer side walls to the region outside the enclosure.

Numerous other features, objects and advantages of the invention will become apparent from the following specification when read in connection with the accompanying drawings.

DETAILED DESCRIPTION OF THE DRAWINGS AND PREFERRED EMBODIMENTS

The following preferred embodiments illustrate the present inventive principles and enable one of ordinary skill in the art to practice the invention as disclosed in embodiments set forth herein as well as in numerous equivalent forms. Components and elements of the respective embodiments having a common character are identified by common numerals for the sake of simplicity.

Figure 1:
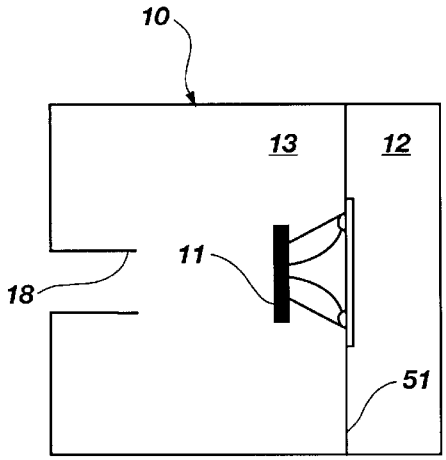
Fig. 1 (PRIOR ART)
FIG. 1 is graphic illustration of a prior art single reflex tuned bandpass enclosure.

FIG. 1 shows a prior art bandpass woofer system of U.S. Pat. No. 2,689,016, granted to Lang, in its simplest form with main enclosure 10 containing a dividing wall 51 forming sub enclosure volumes 12 and 13 with a passive acoustic energy radiator 18 venting sub enclosure volume 13 to the outside environment. The system is driven by a transducer 11. This system has only one Helmholtz-reflex tuning frequency and has slow 12 db/octave stop band slopes and therefore must use lower crossover frequencies and larger, more costly satellite speakers that can play to a lower frequency without overload. Because of only one Helmholtz-reflex tuning frequency it only has one frequency of reduced cone motion. As shown in the above mentioned literature of Fincham this type of system also suffers from out of band resonances that can both color the sound and cause unintended directionality cues.

Figure 2:
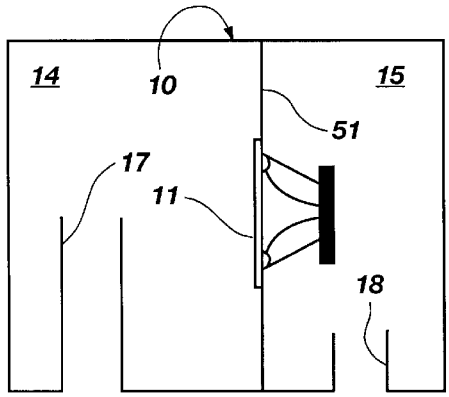
Fig. 2 (PRIOR ART)
FIG. 2 is graphic illustration of a prior art double reflex tuned bandpass enclosure.

FIG. 2 shows a prior art bandpass woofer system of the next level of complexity as shown in U.S. Pat. No. 4,549,631, granted to Bose. Main enclosure 10 contains sub enclosure volumes 14 and with a passive acoustic energy radiator 17 venting sub enclosure volume 14 to the outside environment and passive acoustic energy radiator 18 vents sub enclosure volume 15 to the outside is environment. With the two vent masses and the two subchamber compliances the system forms two Helmholtz-reflex tuning frequencies. Because both subchambers are Helmholtz-reflex systems the low frequency, high pass slope is steep and the high frequency, low pass slope is a shallow 12 dB/octave stop band. This is the opposite of the invention in that it does not have the desirable 12 dB/octave high pass and steep slope low pass characteristics. As with the system in FIG. 1 this system also suffers from out of band resonances that can both color the sound and cause unintended directionality cues.

Figure 3:
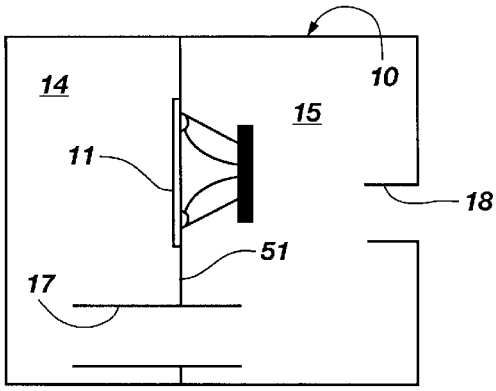
Fig. 3 (PRIOR ART)
FIG. 3 is graphic illustration of another prior art double reflex tuned bandpass enclosure.

FIG. 3 shows an alternative arrangement to FIG. 2 of a dual tuned bandpass system as is disclosed in the U.S. Pat. No. 4,875,546 "Loudspeaker with Acoustic Band-pass Filter" granted to Palo Kman. This system includes an enclosure 10 with two separate chambers 14 and 15 with an active transducer 11 mounted in the dividing panel 51 and communicating to both chambers. One chamber 15 is ported with a passive acoustic radiator 18 communicating to the environment outside the enclosure. There is a second passive acoustic radiator 17 communicating internally between the two chambers. This system suffers from many the same disclosed shortcomings as that of FIG. 2.

Figure 4:
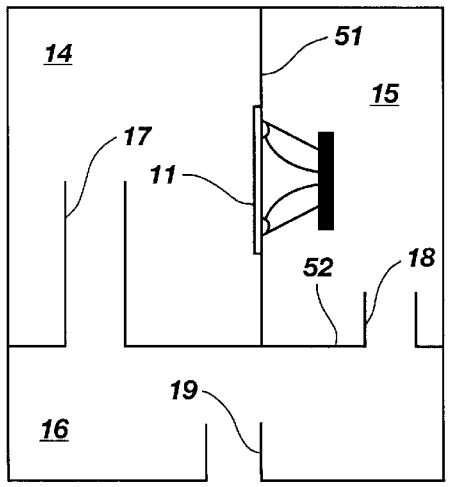
Fig. 4 (PRIOR ART)
FIG. 4 is graphic illustration of a prior art triple reflex tuned bandpass enclosure.

FIG. 4 shows a bandpass system, as disclosed in U.S. Pat. No. 5,092,424 "Electroacoustical Transducing with at Least Three Cascaded Subchambers" granted to Schreiber et al, that is the equivalent of that in FIG. 2 with chambers 14 and 15, and an addition of wall 52 subchamber 16 and vent 19 added to the output vents of the system in FIG. 2. This system has three subchambers and three vents to provide three Helmholtz-reflex tunings, one from each chamber. As with the systems of FIGS. 2 and 3 this device suffers from steep high pass, low frequency rolloff and low frequency out of band cone excursion problems such that it cannot be used below the lowest vent tuning frequency without overload and distortion.

Figure 5:
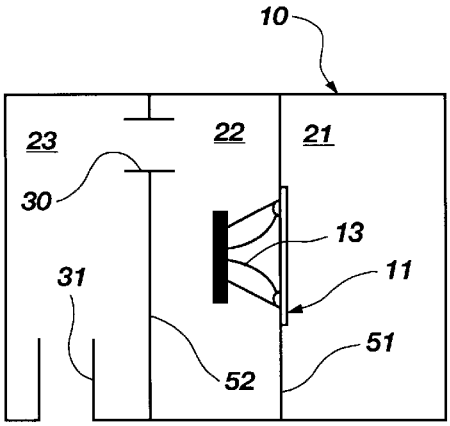
FIG. 5 illustrates a basic form of the invention with three subchambers, two vents, and a sealed acoustic suspension first subchamber.

FIG. 5 shows a basic form of the invention. It illustrates a loudspeaker system comprising, at least one electroacoustical transducer 11 including a vibratable diaphragm 13 for converting an input electrical signal into a corresponding acoustic output signal. An enclosure 10 is divided into at least first subchamber 21, second subchamber 22 and third subchamber 23 by at least first dividing wall 51 and second dividing wall 52. The first dividing wall 51 supports and coacts with the at least one electroacoustical transducer 11 to bound the first and the second subchambers 21 and 22. At least one passive acoustic radiator 30 is specifically designed to realize a predetermined acoustic mass and intercouples the second and third subchambers 22 and 23. At least one additional passive acoustic radiator 31 is specifically designed to realize a predetermined acoustic mass and intercouples the third subchamber to the region outside enclosure 10. Each of the passive acoustic radiators 30 and 31 are specifically designed to realize a predetermined acoustic mass as opposed to just existing as an opening or slot in a dividing wall to permit the passage of sound. Each of the three subchambers have the characterization of acoustic compliance. The acoustic radiators 30 and 31 represent masses which interact with compliances of subchambers 22 and 23 to form a total of two Helmholtz-reflex tunings at two spaced frequencies in the passband of the loudspeaker. These Helmholtz-reflex tunings also establish a total of two spaced frequencies in the passband of the loudspeaker system at which the deflection characteristic of the vibratable diaphragm as a function of frequency has a minimum. In the invention the low pass slope is at least eighteen dB per octave and in the illustrated embodiment of FIG. 5 can operate at twenty four to thirty dB per octave.

The first subchamber 21 is characterized as operating in a non-Helmholtz-reflex mode and is shown as a sealed, acoustic suspension box. The combination of two Helmholtz tunings and at least one non-Helmholtz reflex mode generates the inventive enhancement of the subject bandpass woofer. This is illustrated by the following functional analysis.

The operation of the system is as follows: Starting at the highest frequency of interest there is a high frequency acoustic suspension resonance formed from the mass of the transducer diaphragm 13 resonating with the compliance of subchamber volume 22. At a frequency slightly lower there is a Helmholtz-reflex resonance dominated by the interaction of the mass of passive acoustic radiator 30 with the compliance of subchamber 22. Further down in frequency there is an acoustic suspension resonance formed by the mass of transducer diaphragm 13 resonating with the combined compliance of subchambers 22 and 23 intercoupled by passive acoustic radiator 30. Still further down in frequency is a second Helmholtz-reflex resonance formed by the mass of passive acoustic radiator 31 and the combined compliance of subchambers 22 and 23. The final lowest frequency resonance is formed by coupled mass of transducer diaphragm 13, subchambers 22 and 23, and passive acoustic radiators 30 and 31, all resonating with the compliance of subchamber 21. Below this frequency the high pass slope reaches a stasis of 12 dB per octave.

To achieve desired performance, one approach is to start with the design of a standard bandpass enclosure system, such as the one shown in FIG. 1, as per instruction from literature available to one skilled in the art as taught in, "The Third Dimension: Symmetrically Loaded" by Jean Margerand, Speaker Builder Magazine June 1988. Upon achieving a bandpass curve of desired efficiency, box volume, and low frequency response then the FIG. 5 form of the invention can be realized by adding a second dividing wall 52 and passive acoustic radiator 30 with passive acoustic radiator 30 acoustic mass being chosen to resonate with subchamber 22 acoustic compliance in a manner that causes a second Helmholtz-reflex frequency that is higher than the Helmholtz-reflex frequency of the mass of passive acoustic radiator 31 resonating with the summed acoustic compliance of subchambers 22 and 23 intercoupled by passive acoustic radiator 30. One can adjust for the pass band shape desired using standard design principles known to one skilled in the art.

One preferred embodiment is represented by the following specifications:

| | | |
|---|---|---|
| Subchamber 21 volume: | 313 | cu. in. |
| Subchamber 22 volume: | 58 | cu. in. |
| Subchamber 23 volume: | 241 | cu. in. |
| Vent 30 diameter: | 1.1 | in. |
| Vent 30 length: | 2.25 | in. |
| Vent 31 diameter: | 2.12 | in. |
| Vent 31 length: | 6 | in. |
| Transducer Qe: | 0.39 | |
| Transducer Vas: | 8 | liters |
| Transducer Fs: | 60 | Hz |
| Helmholtz-reflex resonance of Vent 30 and subchamber 22: | 165 | Hz |
| Helmholtz-reflex resonance of Vent 31 and subchambers 22 and 23: | 72 | Hz |
| Fundamental non-Helmholtz-reflex resonance of subchamber 21: | 49 | Hz |
| High Pass - 3 dB: | 48 | Hz |
| Low Pass - 3 dB: | 220 | Hz |

It is generally considered in the art of loudspeaker art that a single subwoofer used in a multi-channel system must normally be crossed over at 120 Hz or lower to not have the high frequencies of the subwoofer start to interfere with the desired stereo separation and directionality of the presented sound field. One of the discoveries of the inventor is that while this is true of woofer systems with a standard lowpass characteristic of 12 or 18 dB per octave the actual criteria for a subwoofer to not disturb directionality is for it to be down by at least 15 to 20 dB at 300 Hz. With standard lowpass slopes this requires a crossover point of no more than approximately 120 Hz. Even when the prior art approach of a steep electronic crossover slope is added to the lowpass slope of the woofer system the program signals are attenuated but the upper frequency (300 Hz or greater) distortion components that are not filtered out by the invented technique can still be substantial and therefore disturb the system directionality and aurally notify the listener of the subwoofer location. Because of the effectiveness of the steep low pass characteristic of at least 18 dB per octave, 24–30 dB per octave in the FIG. 6 embodiment, the invented woofer system can be crossed over a frequencies of 200 Hz or higher while still avoiding listener localization. This is particularly valuable when combined with the slower slope, substantially twelve dB per octave high pass characteristic which allows the development of deeper bass and/or equalized bass that provides exemplary performance for the enclosure size. Further, because of the steep low pass slope, and therefore the ability to use crossover frequencies that are approximately an octave higher than with conventional subwoofers, the upper range speakers can be reduced to one eighth of there previous size and utilize transducers that are only one fourth the cone area. This ability to reduce the size of the upper range speakers when used with the invented woofer system can result in a reduction of 50% or more in the cost of the upper range speakers. This is a significant reduction in a two channel system, which can use one subwoofer and two upper range speakers, and a very significant cost reduction in a home theater, surround sound system that uses five or more channels of upper range speakers combined with a single subwoofer. This cost reduction in the upper range speakers is combined with the distortion reduction and extended low frequency response of the invention to create a new level of system value.

The method that allows for acousti-mechanically configuring a low range speaker system for use in an audio system which enables reduction of speaker size requirements for upper range speaker systems when using said low range speaker system as a subwoofer includes the steps of: a) configuring the low range speaker system to include multiple, low pass acoustic filter structures to achieve at least a third order acoustic low pass characteristic and more preferably a fourth order or greater low pass characteristic, and b) configuring the low range speaker system for operation with a non-Helmholtz-reflex acoustic suspension subchamber to achieve a substantially second order high pass characteristic.

Figure 6:
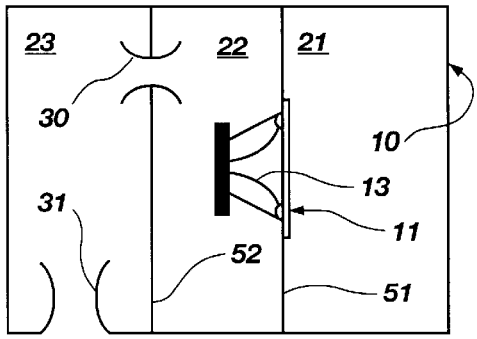
FIG. 6 provides a graphic version of the invention in FIG. 5 with flared vent structures.

FIG. 6. is the same invention as that of the FIG. 5 construction with the modification of passive acoustic radiators 30 and 31 both having flared ends. This can be important on either one or both of the passive radiators to minimize turbulence and audible vent noise.

Figure 7:
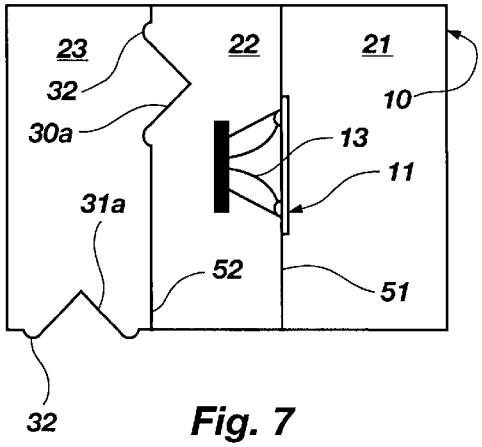
FIG. 7 shows the invention in FIG. 5 modified with passive acoustic diaphragms in place of vents.

FIG. 7 is essentially the invention of FIG. 5 but with passive acoustic diaphragms 30*a* and 31*a* substituting for the vents 30 and 31 of FIG. 5 as passive acoustic radiators. For best performance it can be important to have these passive diaphragm devices have low losses and high compliance in the surround/suspension 32 and also have the ability to maintain linearity while achieving substantial displacements that are equal to or preferably greater than that of the transducer 11. One could choose to use properly designed vents or passive radiators interchangeably in either 30 or 31.

Figure 8:
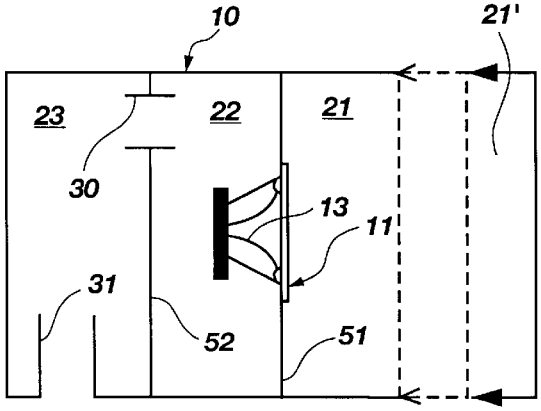
FIG. 8 shows the invention in FIG. 5 with the first subchamber exhibiting highly resistive, non-Helmholtz-reflex, acoustic leakage.

FIG. 8 illustrates the construction of the invention when mounted into a substantially sealed environment, represented by 21', that provides the extended enclosure to enclose subchamber 21 as per the teachings of the invention. The additional sealed environment 21'; adds its compliance to that of the enclosure 21. Therefore, the first portion of subchamber 21 is coupled to and completed by the substantially sealed environment 21' to which the loudspeaker system would be mounted. Examples of this type of installation are shown in FIGS. 13, 14 and 15.

Figure 9:
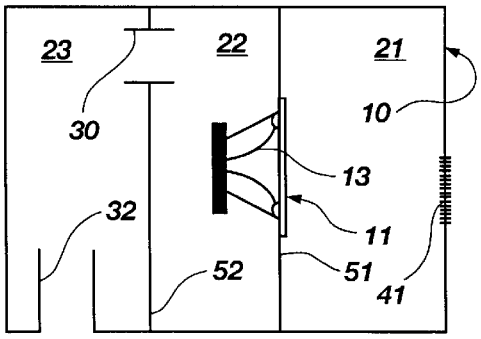
FIG. 9 depicts the invention in FIG. 5 with the first subchamber open and adapted to radiate into a closed space.
Figure 13:
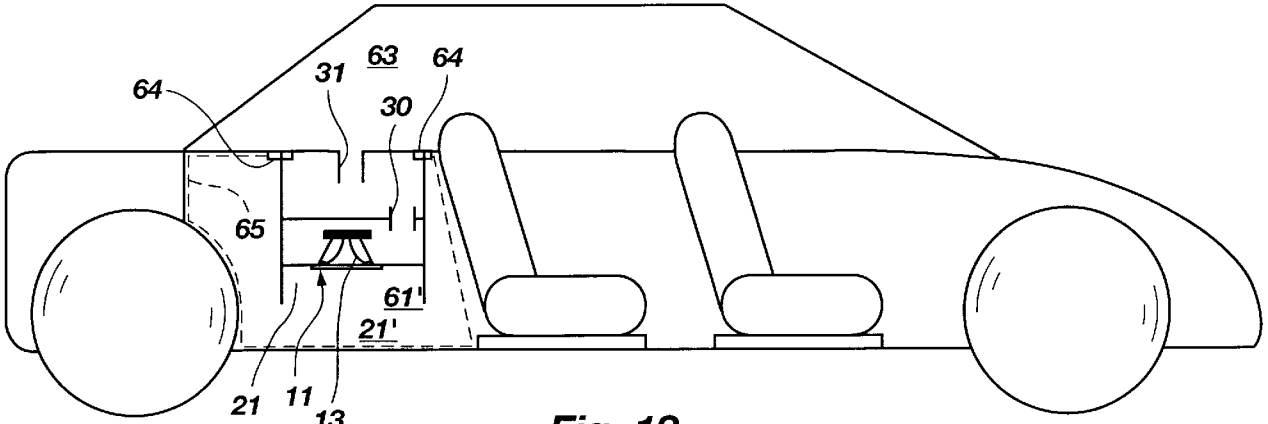
FIG. 13 shows the basic form of the invention adapted to be used in a closed space in an automobile.
Figure 14:
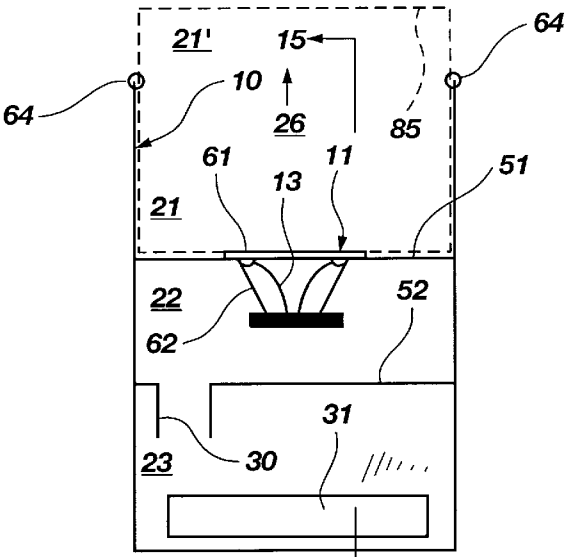
FIG. 14 is a frontal view of the basic form of the invention adapted to be used in a closed space in a building in-wall installation.
Figure 15:
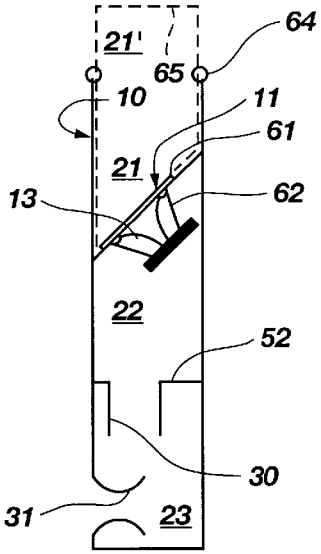
FIG. 15 is a side view of the invention of FIG. 14 is taken along the lines 15—15.

FIG. 9 schematically represents the resistive leakage 41 that may exist in subchamber 21 particularly when the subchamber is not perfectly sealed or when installed in enclosed environments, such as automobiles or buildings, as shown in FIGS. 13, 14, and 15 as is discussed here after. Such leakage is nominal and does not result in a Helmholtz resonance.

This resistive leakage may cause some losses at the acoustic suspension, non-Helmholtz-reflex, resonance of subchamber 21. It is favorable that this leakage be kept to a minimum and to the extent that it does exist it should have the dominant characteristic of acoustic resistance. In some system alignments, the resistive leakage may be used to achieve resistive damping to the electroacoustic transducer. This is particularly useful if a transducer is used that exhibits an underdamped characteristic due to less than ideal magnetic field strength. Other mechanical and acoustical structures that are known in the art can also be used to damp a transducer that has a characteristic of being underdamped or exhibiting excessive amplitude peaking at its fundamental resonance.

Figure 10:
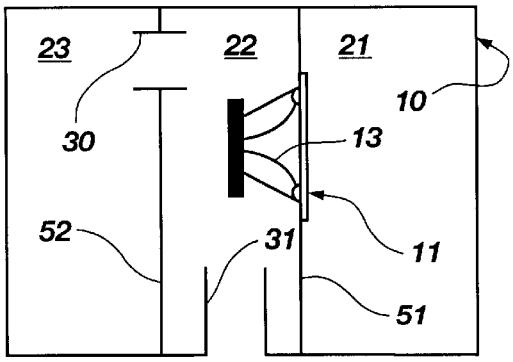
FIG. 10 is another form of the invention with three subchambers and two vents, and a sealed acoustic suspension first subchamber.

FIG. 10 shows another embodiment that can achieve objectives of the invention differing in structure from that of FIG. 5 by the moving of passive acoustic radiator 31 such that it now intercouples the second subchamber 22 with the region outside enclosure 10. To understand the operation of this embodiment, in one preferred alignment, the first, uppermost Helmholtz-reflex resonance is generated by the acoustic mass of passive acoustic radiator 31 interacting with the acoustic compliance of subchamber 22. A second, lower frequency Helmholtz-reflex tuning is created from passive acoustic radiator 30 which effectively couples subchambers 22 and 23 to create a larger combined compliance which then interacts to create the lower tuning frequency.

Figure 11:
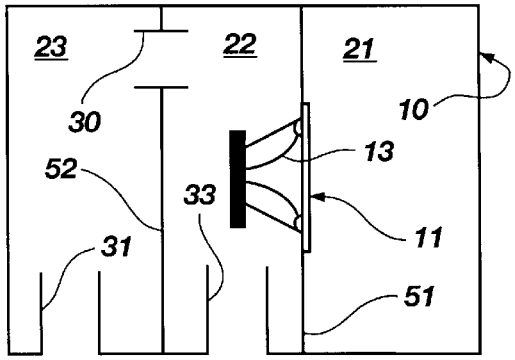
FIG. 11 is another form of the invention with three subchambers and three vents, and a sealed acoustic suspension first subchamber.

FIG. 11 also achieves objectives of the invention differing in structure from that of FIG. 5 by the addition of passive acoustic radiator 33 intercoupling second subchamber 22 to the region outside enclosure 10. In this case, the third passive acoustic radiator does not create a third Helmholtz reflex mode. The acoustic masses 30, 31 and 33 and acoustic compliances 22 and 23 are selected to establish a total of two spaced frequencies in the passband of loudspeaker system at which the deflection characteristic of the vibratable diaphragm 13 as a function of frequency has a minimum. In one alignment of mass/compliance parameters, the system in FIG. 11 operates with all the passive acoustic radiators having the same acoustic mass and interacting with the acoustic compliance of subchambers 22 and 23 such that a first, highest Helmholtz-reflex frequency is established by passive acoustic radiator 30 efficiently coupling the two subchambers 22 and 23. This allows subchambers 22 and 23 to act as one large subchamber with passive acoustic radiators 31 and 33 operating in parallel and resonating with the large, virtual subchamber 22/23. At a frequency spaced apart and lower than the first higher frequency, the mass of passive acoustic radiator 31 resonates with the compliance of subchamber 22 to form a second Helmholtz-reflex mode. These two Helmholtz-reflex modes establish a multi-pole acoustic lowpass filter that has a stop band of at least 24 dB per octave. In one alignment of parameters to have the system function as described above, the subchambers 22 and 23 would be sized approximately in a 60%/40% (of the total subchamber 22 plus subchamber 23 volume) relationship respectively.

Figure 12:
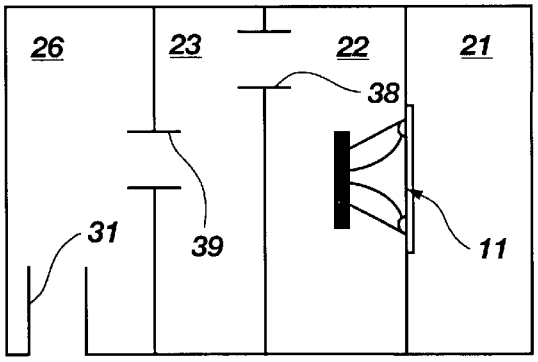
FIG. 12 is another form of the invention with four subchambers and three vents, and a sealed acoustic suspension first subchamber.

FIG. 12 is essentially the invented design of FIG. 6 with the addition of additional subchamber 26 and additional passive acoustic radiator 39 which is specifically designed to realize a predetermined acoustic mass. This elicits a four subchamber design with a total of three Helmholtz-reflex tunings. While the three chamber version of the invention tends, with many preferred alignments, to have at least a fourth order low pass characteristic, the four subchamber, three Helmholtz-reflex tuning version of the invention with many preferred embodiments will have a substantially sixth order low pass characteristic.

FIG. 13 shows the invention as discussed for FIG. 14 mounted in an automobile trunk by mounting structure 64 with the first side 61 of diaphragm 13 of electroacoustic transducer 11 facing into enclosed space 65 which completes the portion 21' of subchamber 21 form substantially sealed subchamber 21. Sound is emitted through port 31 into listening area 63 inside the automobile.

FIGS. 14 and 15 show a loudspeaker system for installation in an enclosed space, such as between wall studs in a building or reinforcement struts of a vehicle wall. This embodiment includes at least one electroacoustical transducer 11 supported on wall 51 and including a vibratable diaphragm 13, with a first side 61 and a second side 62, for converting an input electrical signal into a corresponding acoustic output signal. An enclosure 10 is divided into at least a first subchamber 21 having an opening 26 and second 22 and third 23 subchambers by at least first and second dividing walls 51 and 52. The first dividing wall 51 supports and coacts with the electroacoustical transducer 11 to bound a first portion 21' of the first subchamber 21 and the second subchamber 22. At least one passive acoustic radiator 30 is specifically designed to realize a predetermined acoustic mass and intercouples the second and third subchambers 22 and 23. At least one additional passive acoustic radiator 31 is specifically designed to realize a predetermined acoustic mass and intercouples the third subchamber 23 with the region outside the enclosure.

Each of the passive acoustic radiators 30 and 31 have the characterization of acoustic mass and each of the second and third subchambers 22 and 23 have the characterization of acoustic compliance. The acoustic radiator masses interact with second and third subchamber compliances to form a total of two Helmholtz-reflex tunings at two spaced frequencies in the passband of the loudspeaker.

The first portion 21' of the first subchamber 21 is adapted to be mounted with mounting structure 64 and operate in an enclosed space 65 that completes the first subchamber 21 as a substantially closed, acoustic suspension chamber 21. The invention may be adapted to mounting in any enclosed space that is available and adjacent to a listening area. Some examples would be a vehicle, of which one enclosed space would be an automobile trunk. Mounting structure 64 would comprise a bracket and gasket to support the enclosure as part of the automobile structure. Other examples would an in-wall, in-floor, or in-ceiling spaces in a building, a television set or computer enclosure. In this case mounting structure 64 would include a sealing element to prevent sound leakage.

Figure 16:
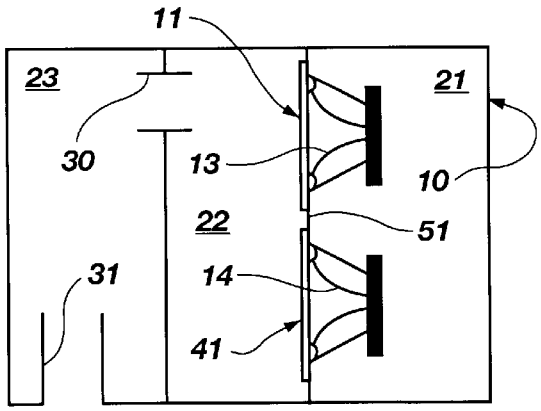
FIG. 16 shows the invention with multiple transducers acoustically in parallel.
Figure 17:
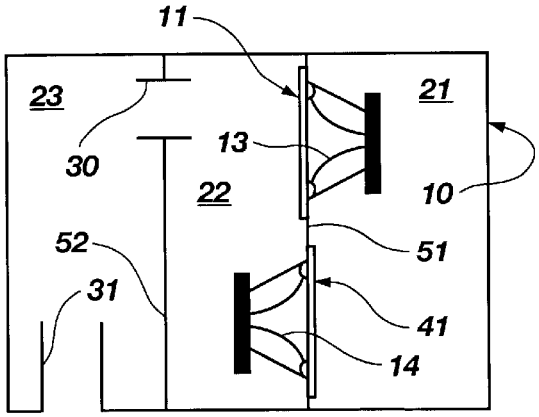
FIG. 17 shows the invention with multiple transducers in an acoustical parallel push-pull arrangement.
Figure 18:
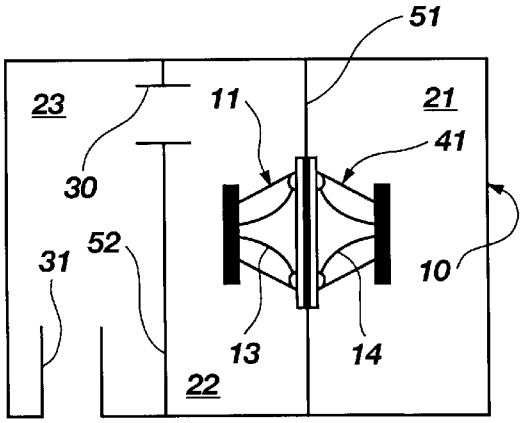
FIG. 18 shows the invention with multiple transducers in an acoustical series push-pull arrangement.

FIGS. 16–18 illustrate that multiple transducers of two or more may be used to advantage with the invention. Some advantages are: synthesizing a virtual transducer of difficult to realize parameters, creating greater thermal capability with multiple voice coils, arranging push pull for cancellation of even order harmonic distortion, etc. Implementing such variations will be understood to those skilled in the art. For example, FIG. 16 is the loudspeaker of FIG. 5 wherein a second transducer 41 with diaphragm 14 is provided in addition to the electroacoustical transducer 11 and is supported by and coacts with the first dividing wall 51 such that both electroacoustical transducers 11 & 41 bound the first 21 and second 22 subchambers. In FIG. 16 the transducers are operating in a physically parallel arrangement and could be wired in either series or parallel.

FIG. 17 is the loudspeaker of FIG. 5 wherein a second transducer 41 is supported by and coacts with the first dividing wall 51 such that both electroacoustical transducers bound the first 21 and second 22 subchambers. Here the transducers are operating in a physically parallel, push-pull arrangement, are wired in opposite electrical phase, relationship to maintain in phase acoustic output, and have either in series or parallel electrical connection. This arrangement can be useful in canceling out asymmetrical, even order harmonic distortion caused by asymmetries in the mechanical suspensions or electrical fields.

FIG. 18 is the loudspeaker of FIG. 5 wherein a second 41 of the at least one electroacoustical transducer 11 is supported by and coacting with the first dividing wall 51 such that both electroacoustical transducers bound the first 21 and second 22 subchambers. Here the transducers are operating in a physical series or isobaric, push-pull arrangement and could be wired in either series or parallel and in opposite electrical phase relationship to maintain in phase acoustic output. This arrangement can have the same distortion reducing advantages as that of FIG. 17 while also simulating a driver that has difficult to achieve parameters such as twice the mass and twice the BL.

Figure 19:
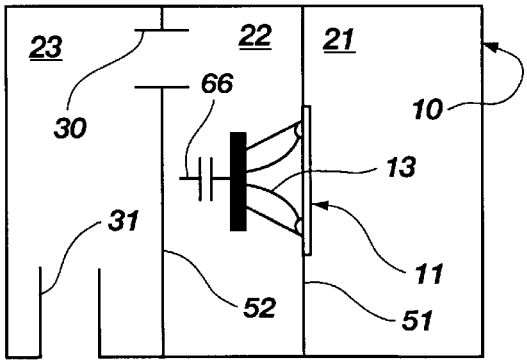
FIG. 19 shows the invention with a series capacitor adding an electrical pole to the high pass characteristic.

FIG. 19 shows the loudspeaker of FIG. 5 wherein the electrical input signal is delivered to the at least one electroacoustical transducer 11 through a series connected capacitor 66. This capacitor can be used to create an additional electrical high pass filter pole in addition to the underdamped substantially second order acoustic high pass characteristic of many preferred embodiments of the invention. This series capacitor can both smooth the peak of an underdamped response, extend the low frequency cutoff of the system and further reduce overload at low frequencies.

Figure 20:
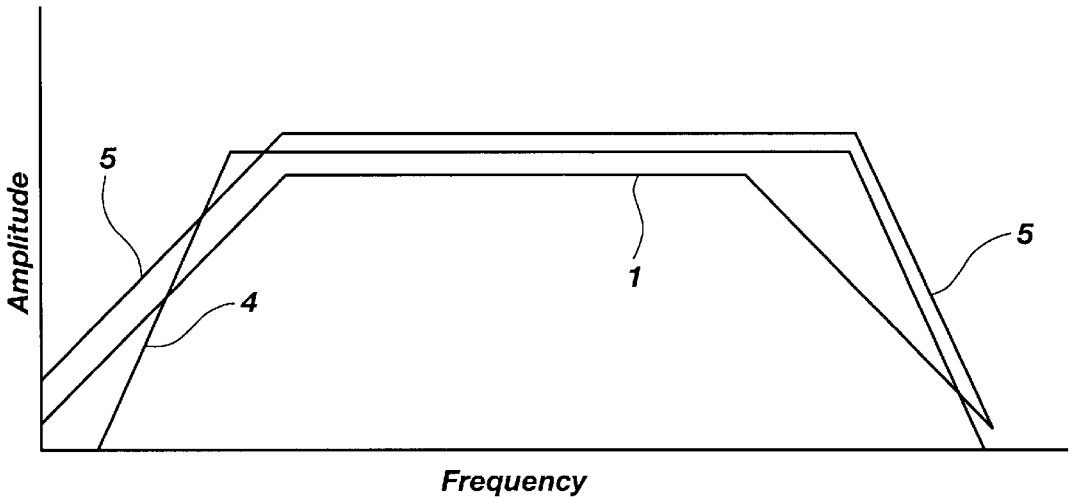
FIG. 20 shows frequency response curves of the invention vs. prior art.

The graph of FIG. 20 shows the relative performance of one embodiment of the invention in FIG. 5 represented by curve 5 and the prior art bandpass woofer systems of FIGS. 1 and 4 represented by curves 1 and 4. These frequency response curves show the advantages of the invention in having an extended range lowpass characteristic with a sharp low pass stop band compared to the slow stop band of system 1. It also shows the slower rolloff high pass stop band having more extended response than that of system 4.

Figure 21:
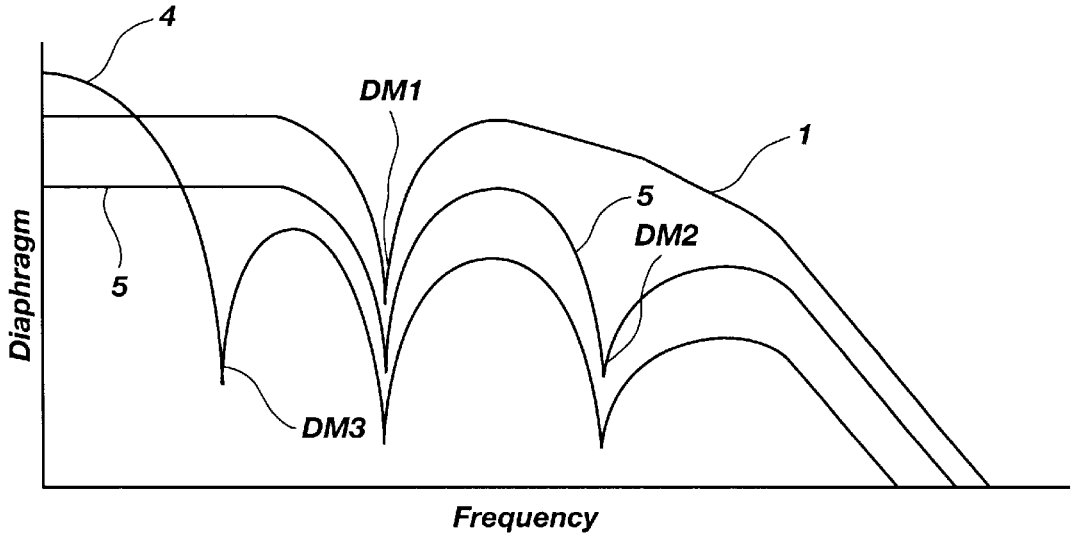
FIG. 21 shows diaphragm displacement curves of the invention vs. prior art.

The graph of FIG. 21 shows the same three systems compared for diaphragm displacement with frequency. While the system of FIG. 4 has its Helmholtz-reflex tunings selected to establish three spaced frequencies in the passband of the loudspeaker system at which the deflection characteristic of the diaphragm as a function of frequency has a minimum (DM1, DM2, DM3), it can be seen that it also has the shortcoming of very high diaphragm displacement below the lowest tuning frequency. The invention not only has the advantage of extended low frequency response shown in FIG. 20, it also has controlled, constant diaphragm displacement all the way down to dc. This allows the lowest frequencies of the invention to still be useful without overload and available to be equalized for even more extended response and/or a dynamic equalizer to be utilized effectively wherein it would not be useful below the lowest tuning frequency of the prior art device of FIG. 4. Further, the invention has a two displacement minimums to minimize diaphragm displacement in the usable passband while the prior art system of FIG. 1 has only one.

Figure 22A:
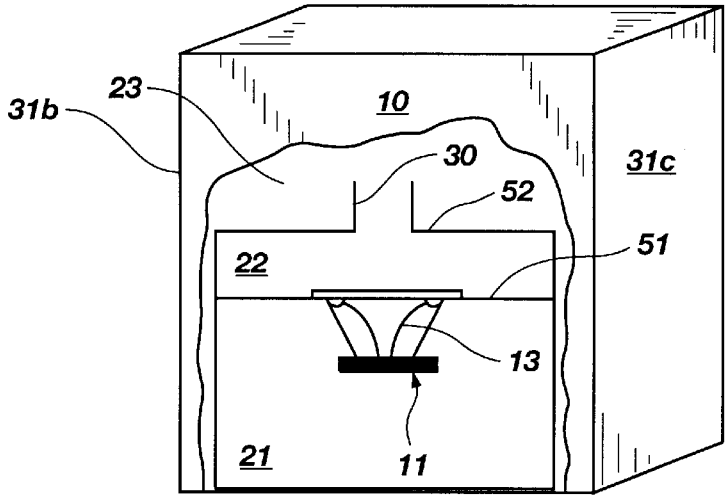
FIG. 22*a* shows a perspective view of the invention of FIG. 5 including a graphic representation of internal components shown in cutaway view, modified to include external sheet material for the passive acoustic radiator.

FIG. 22*a* is essentially the loudspeaker of FIG. 5 (illustrated in graphic form) with outer sidewalls which bound the enclosure to the outside environment. The least one additional passive acoustic radiator 31*b* is comprised of at least one compliant sheet that intercouples the third subchamber 23 through at least one of the outer sidewalls to the region outside the enclosure. A second passive acoustic diaphragm 31*c* is shown on the opposite side of the enclosure. These passive diaphragms can be constructed of a compliant sheet material, such as polyester, rubber or vinyl. They are thickness dimensioned to have the same acoustic mass, as the vent 31 in FIG. 5, for a given tuning frequency and enclosure volume. Because of their large surface areas, they have a much smaller displacement requirement than the passive acoustic diaphragm 31*a* of FIG. 7, which also has an equivalent function in the invention. This diaphragm sheet may be attached to one side of the enclosure and operate through a hole in the enclosure sidewall or it may actually be substantially the size of the entire sidewall. This sheet material may also cover more than one side. It may wrap around the enclosure and cover two, three, four or more sides of the enclosure. There may also be individual sheets placed on two opposing sides as shown. This construction of the invented loudspeaker can contribute to a very light weight version of the system and can achieve very low losses in the passive diaphragms due to their large surface areas. It may also be possible to make these diaphragms visually transparent.

Figure 22B:
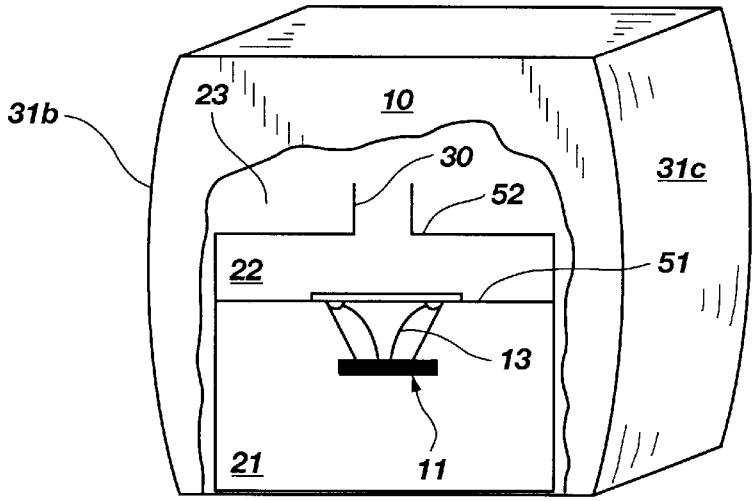
FIG. 22*b* shows the invention of FIG. 22*a* producing a positive output signal.

FIG. 22*b* shows the multiple passive acoustic diaphragm sheet radiators 31*b′* and 31*c* making an outward excursion from the static position of 31*b* and c shown in FIG. 22*a*.

Figure 22C:
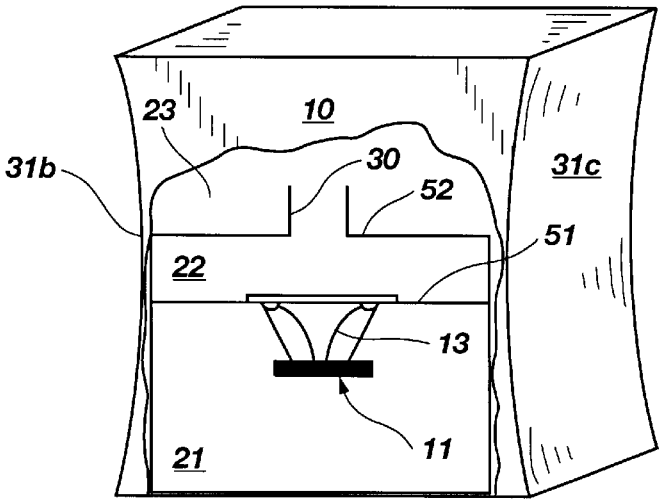
FIG. 22*c* shows the invention of FIG. 22*a* producing a negative output signal.

FIG. 22*c* shows the multiple passive acoustic diaphragm sheet radiators 31*b″* and 31*c″* making an inward excursion from the static position of 31*b* and c of FIG. 22*a*.

It is evident that those skilled in the art may make numerous other modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker system comprising:

at least one electroacoustical transducer for converting an input electrical signal into corresponding acoustic output, an enclosure divided into at least first, second and third subchambers by at least first and second dividing walls, said first dividing wall supporting and coacting with said at least one electroacoustical transducer to bound said first and said second subchambers, at least one passive acoustic radiator specifically designed to realize a predetermined acoustic mass and intercoupling said second and third subchambers, at least one additional passive acoustic radiator specifically designed to realize a predetermined acoustic mass and intercoupling at least one of said second and third subchambers with the region outside said enclosure, each of said subchambers having the characterization of acoustic compliance, said passive acoustic radiator masses interacting with second and third subchamber compliances to form a total of two Helmholtz-reflex tunings at two spaced frequencies in the passband of said loudspeaker, wherein said passive acoustic radiators have the characteristic of acoustic mass and are selected from the group consisting of vents, ports, and suspended passive diaphragms, wherein said first subchamber is characterized as operating in a non-Helmholtz-reflex mode.

2. The loudspeaker of claim 1 wherein said at least one additional passive acoustic radiator intercouples said third subchamber with the region outside said enclosure.

3. The loudspeaker of claim 1 wherein said at least one additional passive acoustic radiator intercouples said second subchamber with the region outside said enclosure.

4. The loudspeaker of claim 3 wherein a second of said at least one additional passive acoustic radiator intercouples said third subchamber with the region outside said enclosure.

5. The loudspeaker of claim 1 wherein at least a second of said at least one electroacoustical transducer is supported by and coacting with said first dividing wall such that said electroacoustical transducer bound said first and said second subchambers.

6. The loudspeaker in claim 5 wherein said electroacoustical transducer are mounted in an mechanical-acoustical parallel arrangement.

7. The loudspeaker in claim 5 wherein said electroacoustical transducer are mounted in an mechanical-acoustical series arrangement.

8. The loudspeaker of claim 1 wherein said enclosure has outer side walls which bound said enclosure to the outside environment, said at least one additional passive acoustic radiator comprised of at least one compliant sheet that intercouples said third subchamber through at least one of said outer side walls to the region outside said enclosure.

9. The loudspeaker of claim 8 wherein said at least one compliant sheet intercouples said third subchamber through two of said outer said walls to the region outside said enclosure.

10. The loudspeaker of claim 8 wherein said at least one compliant sheet intercouples said third subchamber through three of said outer side walls to the region outside said enclosure.

11. The loudspeaker of claim 8 wherein said at least one compliant sheet intercouples said third subchamber through four of said outer side walls to the region outside said enclosure.

12. The loudspeaker of claim 8 wherein said at least one compliant sheet substantially forms at least one of the outer sidewalls.

13. The loudspeaker of claim 8 wherein said at least one compliant sheet substantially forms two of the outer sidewalls.

14. The loudspeaker of claim 8 wherein said at least one compliant sheet substantially forms three of the outer sidewalls.

15. The loudspeaker of claim 8 wherein said at least one compliant sheet substantially forms four of the outer sidewalls.

16. A loudspeaker system comprising:

at least one electroacoustical transducer for converting an input electrical signal into corresponding acoustic output, an enclosure divided into at least first, second and third subchambers by at least first and second dividing walls, said first dividing wall supporting and coacting with said at least one electroacoustical transducer to bound said first and said second subchambers, at least one passive acoustic radiator specifically designed to realize a predetermined acoustic mass and intercoupling said second and third subchambers, at least one additional passive acoustic radiator specifically designed to realize a predetermined acoustic mass and intercoupling at least one of said second and third subchambers with the region outside said enclosure, each of said subchambers having the characterization of acoustic compliance, said passive acoustic radiator masses interacting with second and third subchamber compliances to form a total of two Helmholtz-reflex tunings at two spaced frequencies in the passband of said loudspeaker, wherein said first subchamber is a substantially closed box, acoustic suspension subchamber.

17. The loudspeaker of claim 16 wherein said electrical input signal is delivered to said at least one electroacoustical transducer through a series connected capacitor.

18. A loudspeaker system comprising:

at least one electroacoustical transducer for converting an input electrical signal into corresponding acoustic output, an enclosure divided into at least first, second, third, and fourth subchambers by at least first, second, and third dividing walls, said first dividing wall supporting and coacting with said at least one electroacoustical transducer to bound said first and said second subchambers, at least one passive acoustic radiator specifically designed to realize a predetermined acoustic mass and intercoupling said second and third subchambers, at least one additional passive acoustic radiator specifically designed to realize a predetermined acoustic mass and intercoupling at least one of said second, third, or fourth subchambers with the region outside said enclosure, each of said subchambers having the characterization of acoustic compliance, said passive acoustic radiator masses interacting with second, third, and fourth subchamber compliances to form a total of three Helmholtz-reflex tunings at three spaced frequencies in the passband of said loudspeaker, wherein said first subchamber is a substantially closed box, acoustic suspension subchamber.

19. The loudspeaker of claim 18 wherein said passive acoustic radiators have the characteristic of acoustic mass and are selected from the group consisting of vents, ports, and suspended passive diaphragms.

20. The loudspeaker of claim 18 wherein said electrical input signal is delivered to said at least one electroacoustical transducer through a series connected capacitor.

21. A loudspeaker system comprising:

at least one electroacoustical transducer for converting an input electrical signal into a corresponding acoustic output, an enclosure divided into N number of subchamber by at least N−1 number of dividing walls with $N \geqq 3$, said first dividing wall supporting and coacting with said at least one electroacoustical transducer to bound said first and a second subchamber, at least one passive acoustic radiator specifically designed to realize a predetermined acoustic mass and coupling each subchamber to a region outside each said subchamber except for said first subchamber, at least one additional passive acoustic radiator designed to realize a predetermined acoustic mass and intercoupling at least one of said subchamber, other than said first subchamber, to the region outside said enclosure, said first subchamber characterized as operating in a non-Helmholtz-reflex mode and each of remaining said subchamber having the characterization of acoustic compliance, said passive acoustic radiator masses interacting with subchamber compliances to form a total of N−1 Helmholtz-reflex tunings at spaced frequencies in the passband of said loudspeaker.

22. The loudspeaker of claim 21 wherein said passive acoustic radiators have the characteristic of acoustic mass and are selected from the group consisting of vents, ports, and suspended passive diaphragms.

23. The loudspeaker of claim 22 wherein said first subchamber is a closed box, acoustic suspension subchamber.

24. A loudspeaker system comprising:

at least one electroacoustical transducer having a vibratable diaphragm for converting an input electrical signal into a corresponding acoustic output signal, an enclosure divided into at least first, second and third subchambers by at least first and second dividing walls, said first dividing wall supporting and coacting with said first electroacoustical transducer to bound said first and said second subchambers, at least a first passive radiator specifically designed to realize a predetermined acoustic mass and intercoupling said second and third subchambers, at least a second passive radiator specifically designed to realize a predetermined acoustic mass and intercoupling at least one of said second and third subchambers with the region outside said enclosure, each of said subchambers characterized by acoustic compliance, said passive acoustic radiator masses and said acoustic compliances selected to establish a total of two spaced frequencies in the passband of said loudspeaker system, wherein said passive acoustic radiator has the characteristic of acoustic mass and is selected from the group consisting of vents, ports, and suspended passive diaphargms, wherein said first subchamber is a closed box, acoustic suspension subchamber.

25. The loudspeaker of claim 24, wherein said at least one additional passive acoustic radiator intercouples said third subchamber with the region outside said enclosure.

26. The loudspeaker of claim 24, wherein said at least one additional passive acoustic radiator intercouples said second subchamber with the region outside said enclosure.

27. The loudspeaker of claim 26, wherein a second of said at least one additional passive acoustic radiator intercouples said third subchamber with the region outside said enclosure.

28. A loudspeaker system comprising:

at least one electroacoustical transducer having a vibratable diaphragm for converting an input electrical signal into a corresponding acoustic output signal, an enclosure divided into at least first, second, third and fourth subchambers by at least first, second and third dividing walls, said first dividing wall supporting and coacting with said at least one electroacoustical transducer to bound said first and said second subchambers, at least one passive acoustic radiator specifically designed to realize a predetermined acousti mass and intercoupling said second and third subchambers, at least one additional passive acoustic radiator specifically designed to realize a predetermined acoustic mass and intercoupling said third and fourth subchambers, at least a second additional passive acoustic radiator specifically designed to realize a predetermined acoustic mass and intercoupling at least one of said second, third, or fourth subchambers with the region outside said enclosure, each of said second, third and fourth subchambers having the characterization of acoustic compliance, said passive acoustic radiator masses and said acoustic compliances selected to also establish a total of three spaced frequencies in the passband of said loudspeaker system, wherein said passive acoustic radiator has the characteristic of acoustic mass and being selected from the group consisting of vents, ports and suspended passive diaphragms, wherein said first subchamber is a closed box, acoustic suspension subchamber.

29. A loudspeaker system comprising:

at least one electroacoustical transducer for converting an input electrical signal into a corresponding acoustic output, an enclosure divided into at least first portion of a first subchamber and second and third subchambers by at least first and second dividing walls, said first dividing wall supporting and coacting with said at least one electroacoustical transducer to bound said first portion of said first subchamber and said second subchamber, at least one passive acoustic radiator specifically designed to realize a predetermined acoustic mass and intercoupling said second and third subchambers, at least one additional passive acoustic radiator specifically designed to realize a predetermined acoustic mass and intercoupling at least one of said second and third subchambers with the region outside said enclosure, each of said second and third subchambers having the characterization of acoustic compliance, said passive acoustic radiator masses interacting with second and third subchamber compliances to form a total of two Helmholtz-reflex tunings at two spaced frequencies in the passband of said loudspeaker, said first portion of said first subchamber including mounting structure for attachment to an additional enclosed spaced that completes enclosure of said first subchamber as a substantially closed, acoustic suspension chamber.

30. The loudspeaker of claim 29 wherein said at least one additional passive acoustic radiator intercouples said third subchamber with the region outside said enclosure.

31. The loudspeaker of claim 29 wherein said at least one additional passive acoustic radiator intercouples said second subchamber with the region outside said enclosure.

32. The loudspeaker of claim 31 wherein a second of said at least one additional passive acoustic radiator intercouples said third subchamber with the region outside said enclosure.

33. The loudspeaker of claim 29 wherein said first subchamber has leakage to the region outside said enclosure and said leakage is characterized as an acoustic resistance.

34. A loudspeaker system comprising:

at least one electroacoustical transducer including a vibratable diaphragm for converting an input electrical signal into a corresponding acoustic output signal, an enclosure divided into at least first portion of a first subchamber and second and third subchambers by at least first and second dividing walls, said first dividing wall supporting and coacting with said at least one electroacoustical transducer to bound said first portion of said first subchamber and said second subchamber, at least one passive acoustic radiator specifically designed to realize a predetermined acoustic mass and intercoupling said second and third subchambers, at least one additional passive acoustic radiator specifically designed to realize a predetermined acoustic mass and intercoupling at least one of said second and third subchambers with the region outside said enclosure, each of said second and third subchambers having the characterization of acoustic compliance, said passive acoustic radiator masses interacting with second and third subchamber compliances to form a total of two Helmholtz-reflex tuning at two spaced frequencies in the passband of said loudspeaker, said first portion of said first subchamber being adapted to be mounted and operable in an enclosed spaced that completes enclosure of said subchamber as a substantially closed, acoustic suspension chamber.

* * * * *